US009829853B2

(12) United States Patent
Hashimoto et al.

(10) Patent No.: US 9,829,853 B2
(45) Date of Patent: Nov. 28, 2017

(54) IMAGE FORMING APPARATUS

(71) Applicant: Brother Kogyo Kabushiki Kaisha, Nagoya-shi, Aichi-ken (JP)

(72) Inventors: Junichi Hashimoto, Toyohashi (JP); Yoshiyuki Okazaki, Nagoya (JP); Ryosuke Sakai, Nagoya (JP); Takamasa Tsukada, Ichinomiya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/086,382

(22) Filed: Mar. 31, 2016

(65) Prior Publication Data

US 2016/0291535 A1 Oct. 6, 2016

(30) Foreign Application Priority Data

Mar. 31, 2015 (JP) ..... 2015-074256
Mar. 31, 2015 (JP) ..... 2015-074257

(51) Int. Cl.
*G03G 21/16* (2006.01)
*G03G 21/10* (2006.01)
*G03G 21/12* (2006.01)

(52) U.S. Cl.
CPC ..... *G03G 21/1652* (2013.01); *G03G 21/105* (2013.01); *G03G 21/12* (2013.01);
(Continued)

(58) Field of Classification Search
CPC .. G03G 15/0189; G03G 21/10; G03G 21/105; G03G 21/12; G03G 21/1652;
(Continued)

(56) References Cited

U.S. PATENT DOCUMENTS

2006/0104663 A1* 5/2006 Kitozaki ..... G03G 21/105 399/111
2007/0048005 A1* 3/2007 Nakano ..... G03G 21/1647 399/110

(Continued)

FOREIGN PATENT DOCUMENTS

JP 2010008472 A * 1/2010
JP 2014-219599 A 11/2014

OTHER PUBLICATIONS

Machine translation of JP 2010-008472. Jan. 14, 2010.*

*Primary Examiner* — Carla Therrien
(74) *Attorney, Agent, or Firm* — Banner & Witcoff, Ltd.

(57) ABSTRACT

An image forming apparatus, comprising: a body casing; a drum unit; a belt unit; and a waste toner storage unit, the drum unit comprising: a photosensitive drum; a cleaning unit; and a conveying unit configured to convey toner removed by the cleaning unit, the belt unit comprising: a belt and a unit electric contact, the conveying unit comprises: a conveying member to convey the toner removed by the cleaning unit in a moving direction of the drum unit; and a conveying tube having a discharging outlet configured to let toner carried by the conveying member be discharged to the waste toner storage unit, wherein the discharging outlet is disposed on a downstream side with respect to a body electric contact in a direction pointing from an inside position to an outside position of the drum unit in a state where the drum unit is disposed at the inside position.

9 Claims, 10 Drawing Sheets

(52) U.S. Cl.
CPC ..... *G03G 2215/0141* (2013.01); *G03G 2221/166* (2013.01); *G03G 2221/1684* (2013.01)

(58) Field of Classification Search
CPC . G03G 21/168; G03G 2215/0122–2215/0132; G03G 2221/166; G03G 2221/1684
See application file for complete search history.

(56) References Cited

U.S. PATENT DOCUMENTS

| | | | | |
|---|---|---|---|---|
| 2011/0044743 | A1* | 2/2011 | Yuasa | G03G 21/12 399/358 |
| 2012/0237268 | A1* | 9/2012 | Sakashita | G03G 15/0189 399/258 |
| 2014/0037322 | A1* | 2/2014 | Sato | G03G 21/105 399/101 |
| 2014/0186071 | A1* | 7/2014 | Sato | G03G 15/0194 399/110 |
| 2014/0334842 | A1* | 11/2014 | Fukuchi | G03G 21/105 399/110 |
| 2015/0147090 | A1* | 5/2015 | Sato | G03G 21/169 399/110 |
| 2016/0033927 | A1* | 2/2016 | Sato | G03G 21/0011 399/110 |

* cited by examiner

IMAGE FORMING APPARATUS

CROSS-REFERENCE TO RELATED APPLICATION

This application claims priority under 35 U.S.C. §119 from Japanese Patent Applications No. 2015-074256, filed on Mar. 31, 2015 and No. 2015-074257, filed on Mar. 31, 2015. The entire subject matter of the applications is incorporated herein by reference.

BACKGROUND

Technical Field

The present disclosures relate to an electrophotographic type image forming apparatus.

Related Art

As an electrophotographic type image forming apparatus, a so-called tandem type image forming apparatus having photosensitive drums respectively corresponding to yellow, magenta, cyan and black is known.

One of image forming apparatuses of this type is configured such that a process unit including a plurality of photosensitive drums, a plurality of drum cleaning units configured to remove remaining toner on the photosensitive drums, and a process side conveying tube which is connected to the drum cleaning unit and is configured to collect the remaining toner removed from the photosensitive drums is detachably attachable to the image forming apparatus.

In the image forming apparatus, the process side conveying tube is connected to a belt cleaning unit via a casing side conveying tube, and the remaining toner is stored in a belt cleaner frame of the belt cleaning unit.

SUMMARY

In the above described image forming apparatus, in order to connect the discharging outlet of the process side conveying tube to the casing side conveying tube, it is necessary to push the process unit and to dispose the discharging outlet of the process side conveying tube at a position of the casing side conveying tube.

Further, in the image forming apparatus of this type, it is necessary to supply electric power to the process unit by letting an electric contact of a body casing contact the process unit. In such a case, the discharging outlet of the process side conveying tube passes through the electric contact of the body casing before the discharging outlet of the process side conveying tube reaches the casing side conveying tube. In this case, the electric contact may get dirty when toner leaks from the discharging outlet of the process side conveying tube.

In consideration of the above, aspects of the disclosures provide an image forming apparatus capable of conveying toner removed from a photosensitive drum to a waste toner storage unit without causing a body electric contact to get dirty by the toner.

According to an aspect of the disclosures, there is provided an image forming apparatus, comprising: a body casing having a body electric contact to be electrically connected to a power source; and a drum unit configured to move between an inside position inside the body casing and an outside position outside the body casing in a moving direction of the drum unit. The drum unit comprises: a photosensitive drum having an axis extending in an axis direction; a cleaning unit configured to remove toner remaining on a surface of the photosensitive drum; and a conveying unit configured to convey the toner removed by the cleaning unit. The image forming apparatus further comprises a belt unit having a belt frame. The belt unit comprises: a belt which is in contact with the photosensitive drum of the drum unit disposed at the inside position and is supported by the belt frame; and a unit electric contact which is disposed on an outer surface of the belt frame in the axis direction and is in contact with the body electric contact. The image forming apparatus further comprises a waste toner storage unit configured to store the toner conveyed by the conveying unit. The conveying unit comprises: a conveying member configured to convey the toner removed by the cleaning unit in the moving direction; and a conveying tube extending in the moving direction and accommodating the conveying member. The conveying tube has a discharging outlet configured to let the toner carried by the conveying member be discharged to the waste toner storage unit through the discharging outlet. The discharging outlet of the conveying tube is disposed on a downstream side with respect to the body electric contact in a direction pointing from the inside position to the outside position of the drum unit in a state where the drum unit is disposed at the inside position.

According to another aspect of the disclosures, there is provided an image forming apparatus, comprising: a body casing; and a drum unit configured to move between an inside position inside the body casing and an outside position outside the body casing in a moving direction of the drum unit. The drum unit comprises: a photosensitive drum having an axis extending in an axis direction; a cleaning unit configured to remove toner remaining on a surface of the photosensitive drum; and a conveying unit configured to convey the toner removed by the cleaning unit. The image forming apparatus further comprises: a belt unit having a belt which is in contact with the photosensitive drum of the drum unit disposed at the inside position, the belt unit being configured to be detachably attachable to the body casing; and a waste toner storage unit configured to store the toner conveyed by the conveying unit and to be detachably attachable to the body casing. The body casing comprises a recessed part formed to be recessed toward an outer side in the axis direction. The recessed part comprises an inclined surface inwardly inclined in the axis direction toward an upper side. The conveying unit comprises: a conveying member configured to convey the toner removed by the cleaning unit in the moving direction; and a conveying tube extending in the moving direction and accommodating the conveying member, the conveying tube having a discharging outlet configured to let the toner carried by the conveying member be discharged to the waste toner storage unit through the discharging outlet. The waste tone storage unit comprises: a body part configured to store the toner; and a connecting part extending to an upper side from the body part, the connecting part having a communicating port configured to let the toner passed through the discharging outlet be received through the communication port, the communicating port overlapping with the inclined surface in an up and down direction in a state where the drum unit is disposed at the inside position.

According to another aspect of the disclosures, there is provided an image forming apparatus, comprising: a body casing; and a drum unit configured to move between an inside position inside the body casing and an outside position outside the body casing in a moving direction of the drum unit. The drum unit comprises: a photosensitive drum having an axis extending in an axis direction; a cleaning unit configured to remove toner remaining on a surface of the photosensitive drum; and a conveying unit configured to convey the toner removed by the cleaning unit. The image forming apparatus further comprises: a belt unit having a belt which is in contact with the photosensitive drum of the drum unit disposed at the inside position, the belt unit being configured to be detachably attachable to the body casing; and a waste toner storage unit configured to store the toner conveyed by the conveying unit and to be detachably attachable to the body casing. The body casing comprises a recessed part formed to be recessed toward an outer side in the axis direction. The recessed part comprises an inclined surface inwardly inclined in the axis direction toward an upper side. The conveying unit comprises: a conveying member configured to convey the toner removed by the cleaning unit in the moving direction; and a conveying tube extending in the moving direction and accommodating the conveying member, the conveying tube having a discharging outlet configured to let the toner carried by the conveying member be discharged to the waste toner storage unit through the discharging outlet. The waste tone storage unit comprises: a body part configured to store the toner; and a connecting part extending to an upper side from the body part, the connecting part having a communicating port configured to let the toner passed through the discharging outlet be received through the communicating port. When the waste toner storage unit is attached to the body casing, the connecting part moves downward on an inner side in the axis direction with respect to the recessed part, moves outward in the axis direction, and then is disposed in the recessed part on a lower side with respect to the inclined surface.

BRIEF DESCRIPTION OF THE ACCOMPANYING DRAWINGS

Figure 6A:
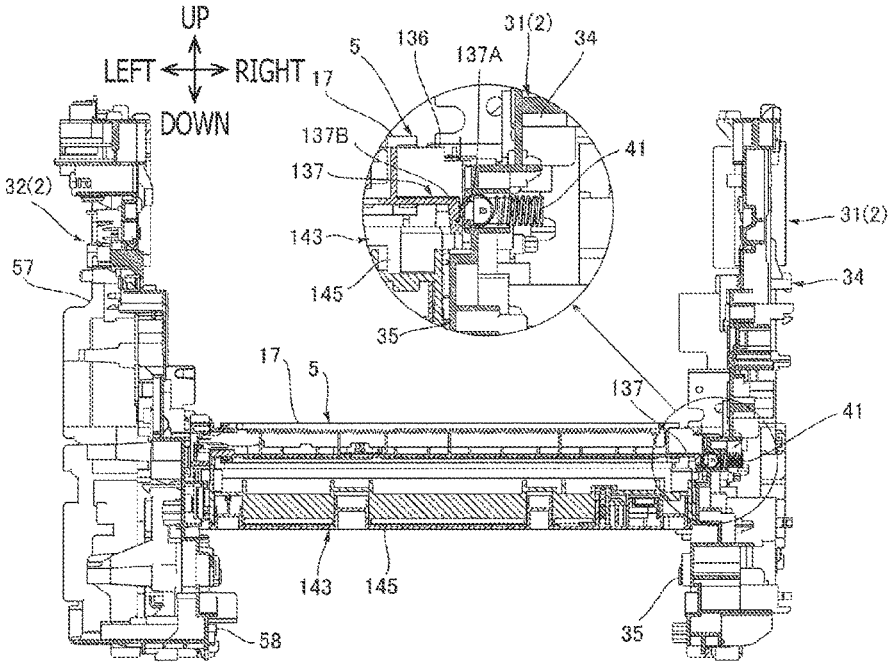
FIG. 6A is a front cross sectional view illustrating a state where a first body electric contact contacts a first unit electric contact.
Figure 6B:
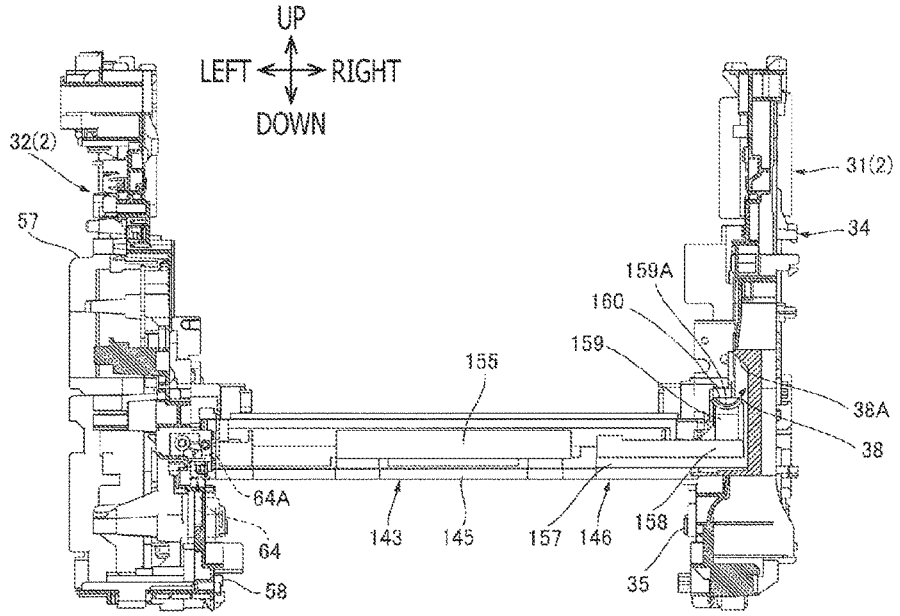
FIG. 6B is a front cross sectional view illustrating a state where the waste toner storage unit is attached to a body casing.
Figure 7A:
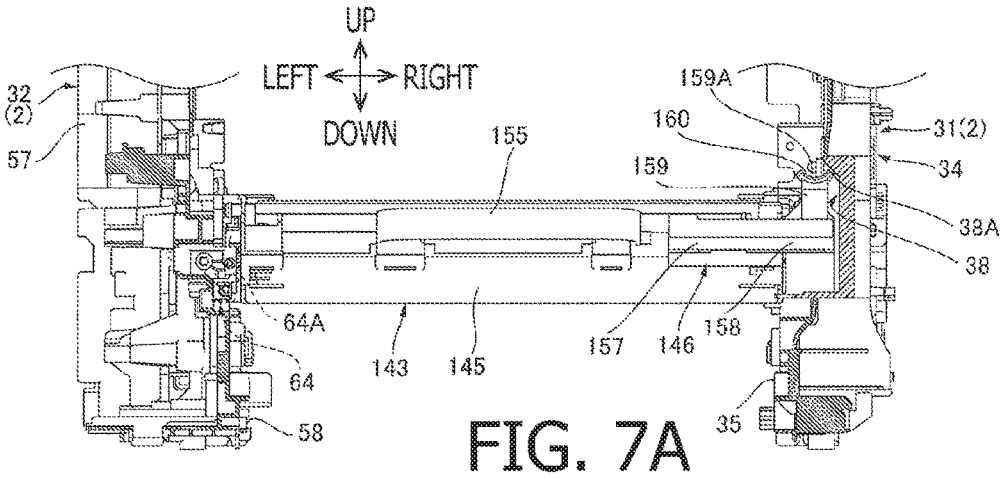
Figure 7B:
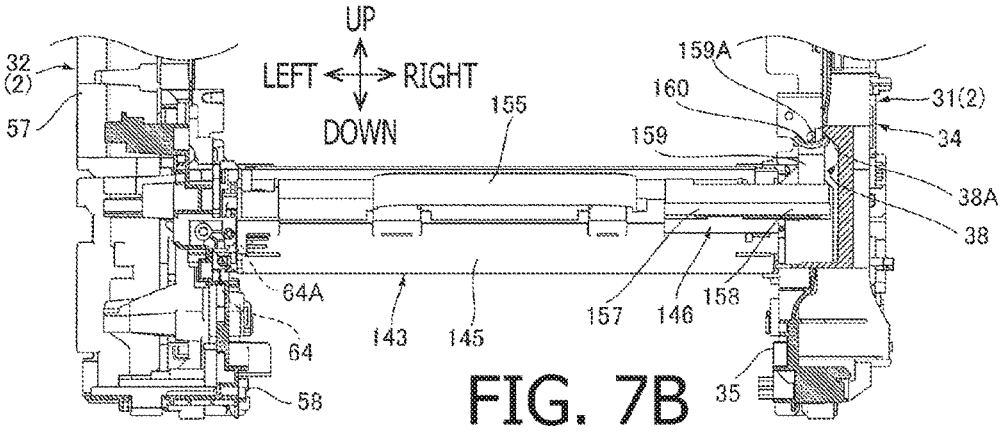
Figure 7C:
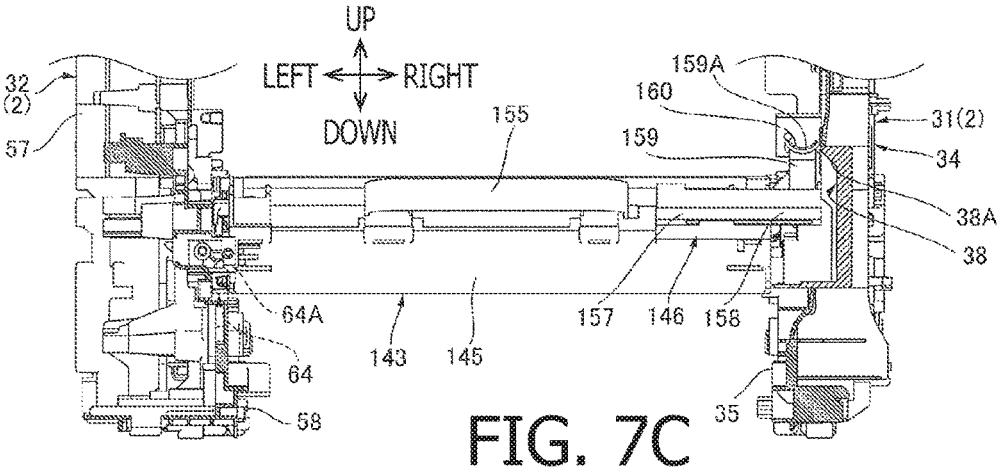

FIG. 7A is an explanatory illustration for explaining attaching/detaching of the waste toner storage unit shown in FIG. 6B with respect to the body casing and illustrates a state where a connecting part contacts an inclined surface of a recessed part, FIG. 7B is an explanatory illustration for explaining attaching/detaching of the waste toner storage unit following the state of FIG. 7A and illustrates a state where the connecting part is guided along the inclined surface and the waste toner storage unit is moved to a left side, and FIG. 7C is an explanatory illustration for explaining attaching/detaching of the waste toner storage unit following the state of the FIG. 7B and illustrates a state where the waste toner storage unit is disposed on a left side with respect to the recessed part.

Figure 1:
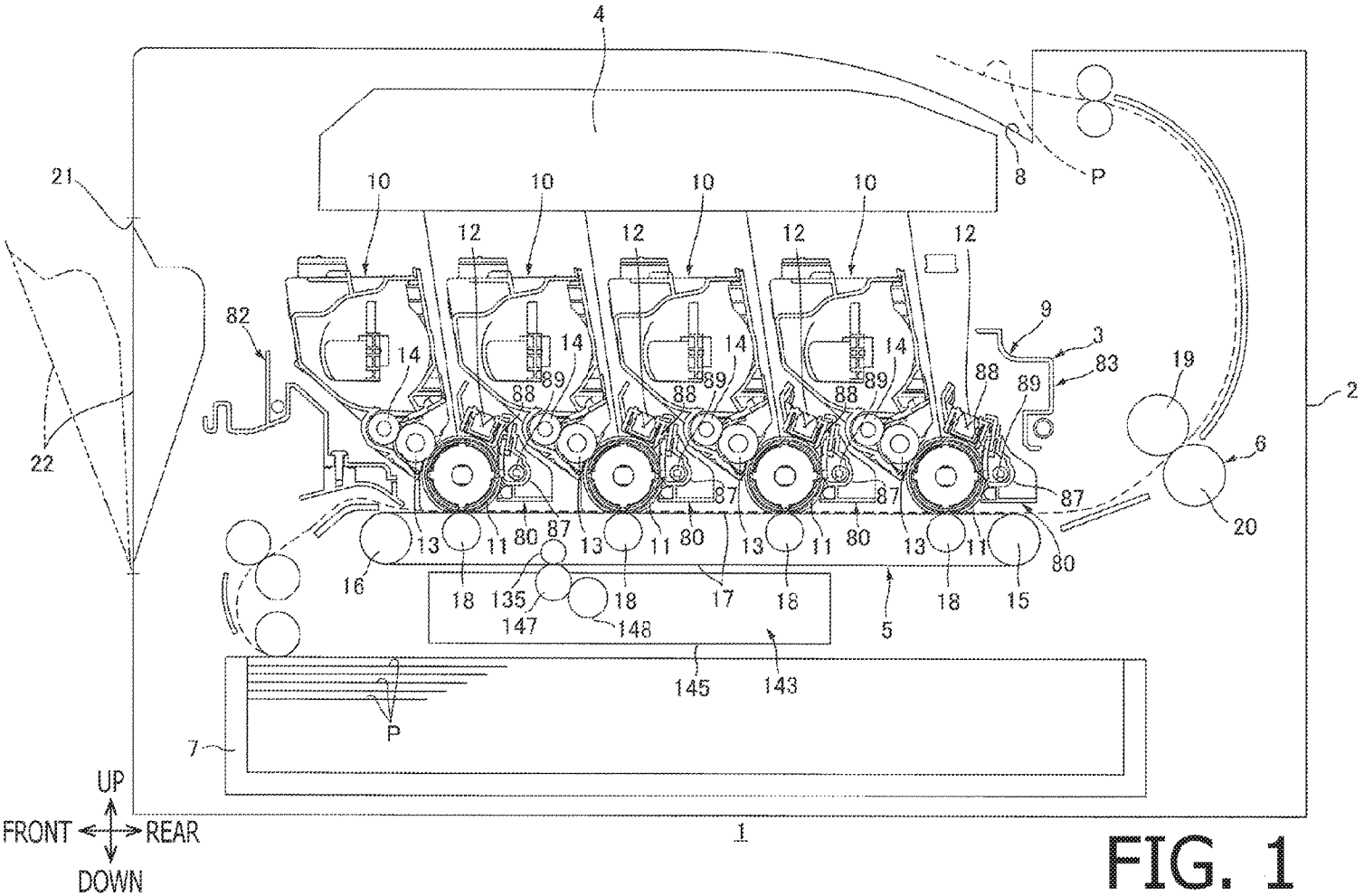
FIG. 1 is a central cross sectional view of an image forming apparatus according to a first embodiment.
Figure 8A:
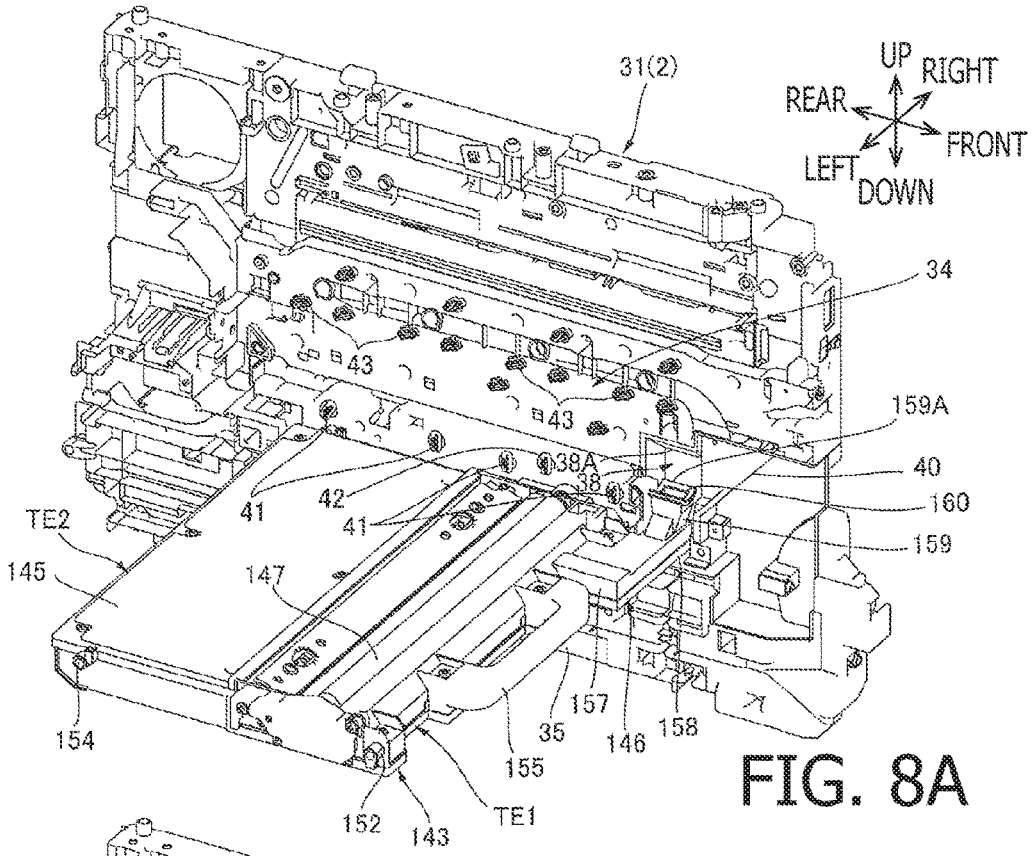
Figure 8B:
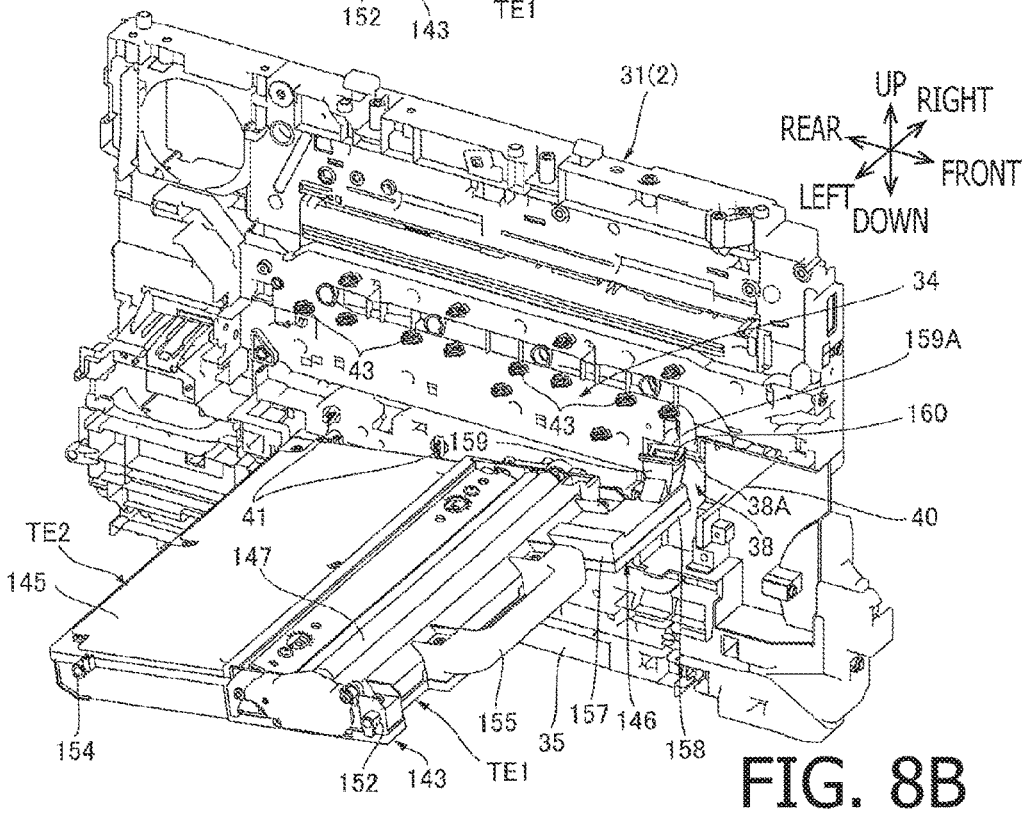

FIG. 8A is a perspective view illustrating a state where the waste toner storage unit shown in FIG. 1 is accommodated in the body casing, and FIG. 8B is an explanatory illustration for explaining attaching/detaching of the waste toner storage unit shown in FIG. 8A with respect to the body casing.

Figure 9A:
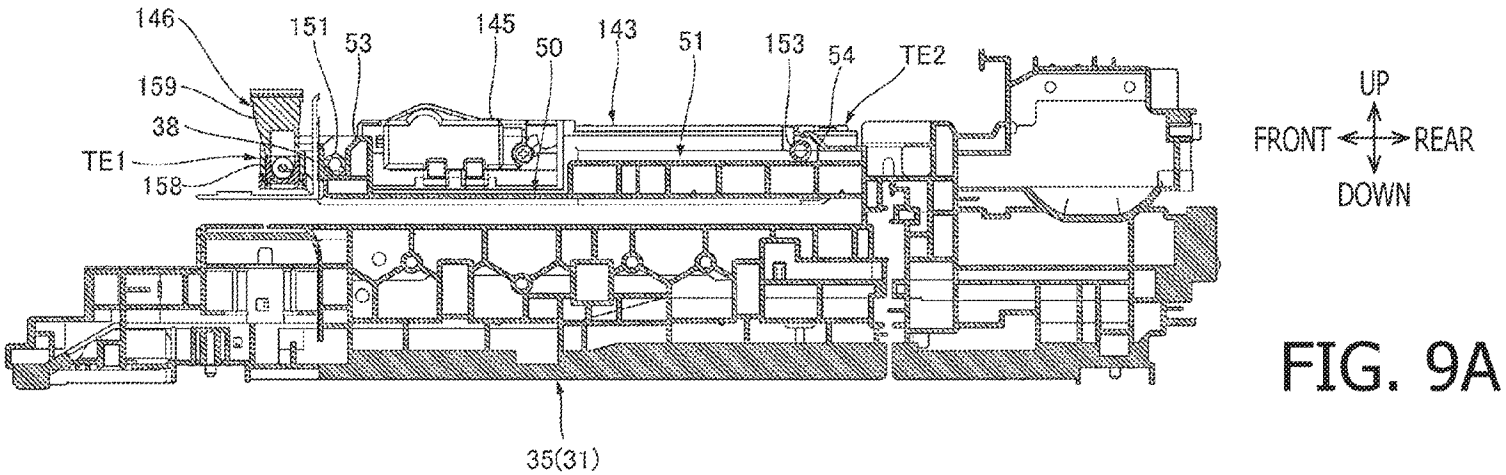
Figure 9B:
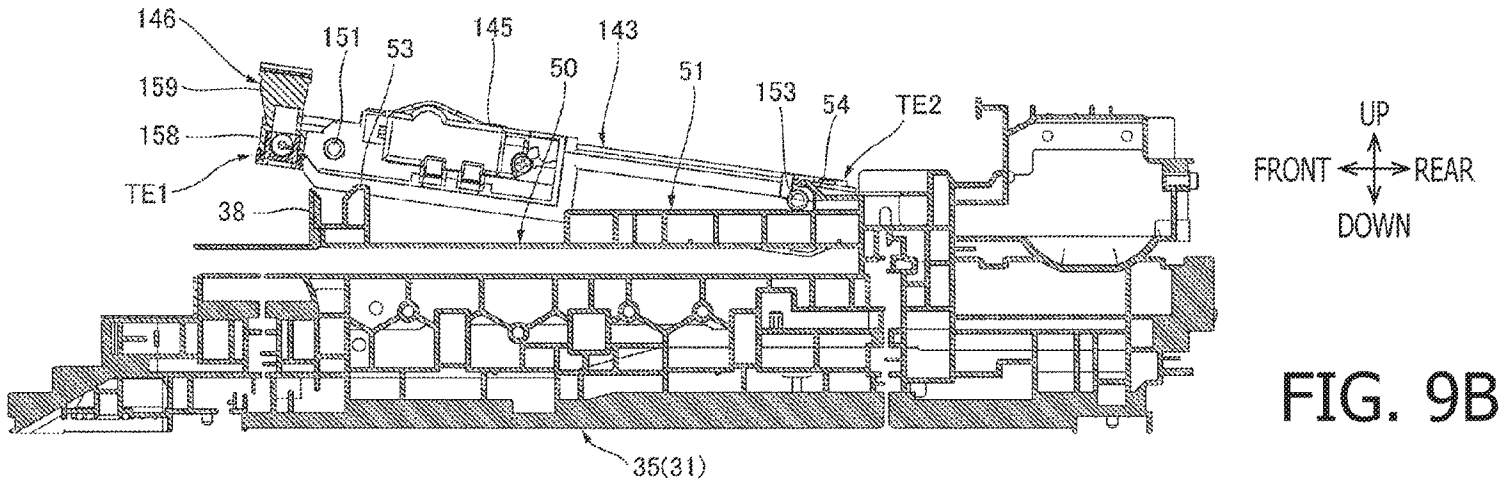

FIG. 9A is a side cross section of a first frame and the waste toner storage unit shown in FIG. 8A, and FIG. 9B is a side cross section of the first frame and the waste toner storage unit shown in FIG. 8B.

Figure 10:
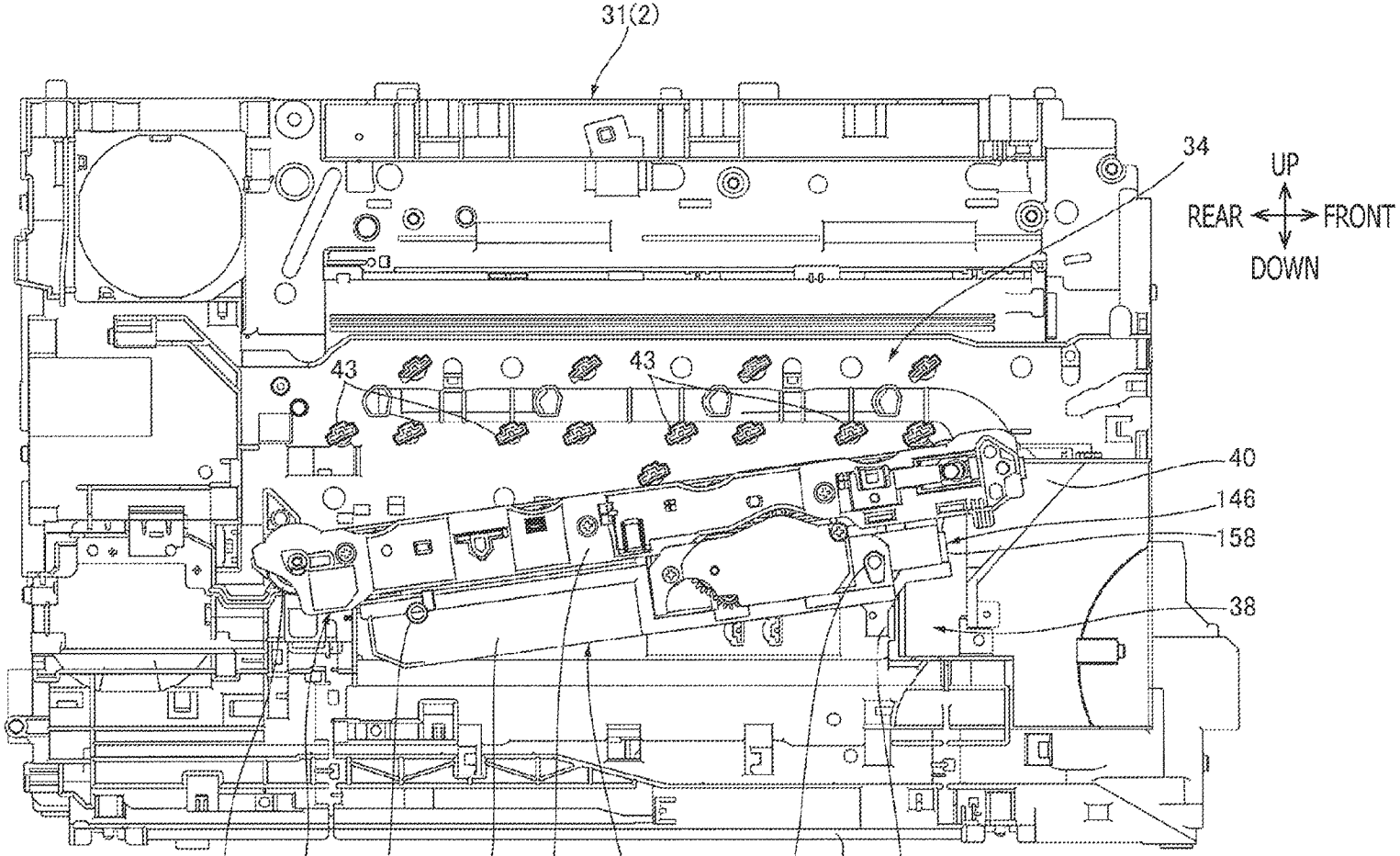

FIG. 10 is a side view illustrating attaching/detaching of a belt unit and a waste toner storage unit with respect to a body casing in an image forming apparatus according to a second embodiment.

DETAILED DESCRIPTION

1. Overall Configuration of Image Forming Apparatus

As shown in FIG. 1, an image forming apparatus 1 is a horizontal direct tandem type color laser printer.

The image forming apparatus 1 includes a body casing 2 having an opening 21, a process unit 3, a scanner unit 4, a belt unit 5 and a fixing unit 6.

The body casing 2 is formed in a box-shape. The body casing 2 has a front cover 22, a paper supply tray 7 and a discharge tray 8.

The opening 21 is disposed at a front end part of the body casing 2. The opening 21 lets the inside of the body casing 2 and the outside of the body casing 2 communicate with each other in the front and rear direction so as to allow the process unit 3 to pass through the opening 21.

The front cover 22 is disposed at the front end part of the body casing 2. The front cover 22 has a flat plate-like shape. The front cover 22 is disposed to extend in the up and down direction and is supported to be able to swing, with respect to a front wall of the body casing 2, about a lower end of the front cover 22 serving as a fulcrum. Thus, the front cover 22 is configured to open or close the opening 21.

The paper supply tray 7 is disposed in a bottom portion of the body casing 2. The paper supply tray 7 is configured to store sheets of paper P.

The discharge tray 8 is disposed on an upper wall of the body casing 2. The discharge tray 8 is formed to be recessed downward from an upper surface of the body casing 2 so that the sheets of paper P can be placed on the discharge tray 8.

The process unit 3 is disposed in a central portion of the body casing 2. The process unit 3 is slidable in the front and rear direction, via the opening 21, between an inside position where the process unit 3 is disposed in the inside of the body casing 2 and an outside position where the process unit 3 is dispose outside the body casing 2. The process unit 3 includes a drum unit 9 and a plurality of (four in this embodiment) development cartridges 10.

The drum unit 9 includes a plurality of (four in this embodiment) photosensitive drums 11 and a plurality of (four in this embodiment) scorotron chargers 12.

The photosensitive drums 11 are rotatably supported at a lower end part of the process unit 3. The four photosensitive drums 11 correspond to yellow, magenta, cyan and black, respectively. The four photosensitive drums 11 are arranged from the front side to the rear side in the order of yellow, magenta, cyan and black to have intervals therebetween. Each photosensitive drum 11 has a cylindrical shape extending in the left and right direction.

The scorotron charger 12 is disposed on the upper rear side of the corresponding photosensitive drum 11 to have an interval therebetween.

The four development cartridges 10 have the same configuration excepting colors of the toner stored therein. The development cartridge 10 is disposed on the upper side of the corresponding photosensitive drum 11. The development cartridge 10 includes a development roller 13 and a supply roller 14.

The development roller 13 is rotatably supported in a lower end portion of the development cartridge 10 to be exposed toward the rear side. The development roller 13 contacts the upper front edge of the photosensitive drum 11.

The supply roller 14 is disposed on the upper front side of the development roller 13. The supply roller 14 contacts the upper front edge of the development roller 14.

The scanner unit 4 is disposed in an upper end portion of the body casing 2. As shown as solid lines in FIG. 1, the scanner unit 4 emits laser beams to the respective photosensitive drums 11 to expose the respective photosensitive drums 11.

The belt unit 5 is disposed under the process unit 3. The belt unit 5 is configured to be detachably attachable to the body casing 2. The belt unit 5 includes a drive roller 15, a driven roller 16, a belt 17 and a plurality of (four in this embodiment) transfer rollers 18.

The drive roller 15 is disposed at a rear end part of the belt unit 5.

The driven roller 16 is disposed at a front end part of the belt unit 5 such that the driven roller 16 faces the drive roller 15 from the front side and has an interval with respect to the drive roller 15.

The belt 17 is provided to be wound around the drive roller 15 and the driven roller 16 such that, when the drum unit 9 is disposed at the inside position, an upper part of the belt 17 contacts all of the photosensitive drums 11. The belt 17 is moved to circulate in accordance with the driving motion of the drive roller 15 and the following motion of the driven roller 16 such that the upper part of the belt 17 moves from the front side to the rear side.

The transfer rollers 18 are disposed under the respective photosensitive drums 11 to sandwich the upper part of the belt 17 between the transfer rollers 18 and the photosensitive drums 11.

The fixing unit 6 is disposed on a rear side of the belt unit 5. The fixing unit 6 includes a heat roller 19 and a pressure roller 20 contacting the heat roller 19.

When image formation operation is started by the image forming apparatus 1, the scorotron charger 12 charges uniformly a surface of the photosensitive drum 11. Then, the scanner unit 4 exposes the surface of the photosensitive drum 11. As a result, an electrostatic latent image based on image data is formed on the surface of the photosensitive drum 11.

The supply roller 14 supplies toner in the development cartridge 10 to the development roller 13. At his time, the toner is charged positively between the development roller 13 and the supply roller 14, and is held on the development roller 13.

The development roller 13 supplies the toner which is held thereon, to the electrostatic latent image on the surface of the photosensitive drum 11. As a result, a toner image is held on the surface of the photosensitive drum 11.

Through rotations of the various rollers, the sheet of paper P is conveyed from the paper supply tray 7 toward the upper front side and then is conveyed toward the upper rear side while making a U-turn, so that the sheet of paper P is supplied one by one at predetermined timing to a position between the photosensitive drum 11 for yellow and the belt 17. Subsequently, the sheet of paper P is conveyed from the front side to the rear side by the belt 17. The toner image on the photosensitive drum 11 is transferred to the sheet of paper P while the sheet of paper P passes through the position between the photosensitive drum 11 and the transfer roller 18.

Then, the sheet of paper P is heated and pressed when the sheet of paper P passes through a position between the heat roller 19 and the pressure roller 20. At this time, the toner image on the sheet of paper P is thermally fixed to the sheet of paper P. Subsequently, the sheet of paper P is discharged to the discharge tray 8.

2. Details about Body Casing

As shown in FIGS. 6A and 6B, the body casing 2 includes a first frame 31 and a second frame 32.

As shown in FIGS. 6A and 8A, the first frame 31 is disposed at the right end part of the body casing 2. The first frame 31 has a rectangular flat shape when viewed as a side view. The first frame 31 includes a first side frame 34 having a recessed part 38, and a first lower frame 35.

The first side frame 34 forms an upper half part of the first frame 31. The first side frame 34 has a rectangular flat shape when viewed as a side view. The first side frame 34 includes a contacting part 40, a plurality of (four in this embodiment) first body electric contacts 41, one second body electric contact 42, and a plurality of (four in this embodiment) third body electric contacts 43.

As shown in FIG. 8A, the recessed part 38 is disposed at the lower front part of the first side frame 34. The recessed part 38 is formed to be recessed rightward from a left surface of the first side frame 34. The recessed part 38 has a rectangular shape when viewed as a side view. As shown in FIG. 6B, the recessed part 38 has a trapezoidal shape in which an upper end part of the recessed part 38 is upwardly inclined toward the left side when viewed as a front cross sectional view. The upper surface of the recessed part 38 is formed as a first inclined surface 38A.

As shown in FIGS. 8A and 8B, the contacting part 40 is disposed on the front side of the recessed part 38 in the first side frame 34. When viewed as a side view, the contacting part 40 has a triangular flat plate-like shape formed such that the lower front surface of the contacting part 40 is downwardly inclined toward the rear side.

As shown in FIG. 8A, the four first body electric contacts 41 are disposed in the lower end part of the first side frame 34 to be spaced from each other in the front and rear direction. As shown in FIG. 6A, the first body electric contact 41 is formed of a coil spring extending in the left and right direction. The coil spring is configured by winding a metal wire. The right end of the first body electric contact 41 is fixed to the inside of the first side frame 34, and the left end of the first body electric contact 41 projects to the left side relative to the left surface of the first side frame 34. The first body electric contacts 41 are electrically connected to an external power source (not shown).

As shown in FIG. 8A, the one second body electric contact 42 is disposed between the frontmost first body electric contact 41 and the first body electric contact 41 next to the frontmost first body electric contact 41. Although not shown in the drawings, the second body electric contact 42 has the same configuration as that of the first body electric contact 41. That is, the second body electric contact 42 is formed of a coil spring extending in the left and right direction. The right end of the second body electric contact 42 is fixed to the inside of the first side frame 34, and the left end of the second body electric contact 42 projects to the left side with respect to the left surface of the first side frame 34.

The second body electric contact 42 is electrically connected to an external power source (not shown).

The four third body electric contacts 43 are disposed in a central portion of the first side frame 34 in the up and down direction to be spaced from each other in the front and rear direction. Although not shown in the drawings, similarly to the first body electric contact 41 and the second body electric contact 42, the third body electric contact 43 is formed of a coil spring. The right end of the third body electric contact 43 is fixed to the inside of the first side frame 34, and the left end of the third body electric contact 43 projects leftward with respect to the left surface of the first side frame 34. The third body electric contact 43 is electrically connected to an external power source (not shown).

As shown in FIGS. 6A and 8A, the first lower frame 35 is formed to extend downward to continue from the lower end part of the first side frame 34. The first lower frame 35 has a rectangular flat plate-like shape when viewed as a side view. The left end part of the first lower frame 35 projects to the left side with respect to the left end part of the first side frame 34. As shown in FIGS. 9A and 9B, the first lower frame 35 includes a support part 50 and an expanded part 51.

The support part 50 is a part projecting to the left side with respect to the left end part of the first side frame 34, and has a flat plate-like shape extending in the front and rear direction. The support part 50 includes a catching part 53.

The catching part 53 is disposed at the front end part of the support part 50. Although not shown in the drawings, the catching part 53 is disposed on the rear side of the recessed part 38 to adjoin the recessed part 38. The catching part 53 projects upward from the upper surface of the support part 50, and is formed of a flat plate-like member to form a shape of a letter U whose upper side is opened.

The expanded part 51 is expanded upward from an upper surface of a rear half part of the support part 50. The expanded part 51 has a shape of a rectangular column extending in the front and rear direction, and the expanded part 51 includes a positioning part 54.

The positioning part 54 is disposed at the rear end part of the expanded part 51. The positioning part 54 is formed in a shape of a claw in which the positioning part 54 extends upward from the upper surface of the expanded part 51, extends to the upper front side, and then extends to the front side.

As shown in FIGS. 6A and 6B, the second frame 32 is disposed at the left end part of the body casing 2 to be spaced leftward from the first frame 31. The second frame 32 has a rectangular flat plate-like shape when vided as a side view. The second frame 32 includes a second side frame 57 and a second lower frame 58.

Figure 3:
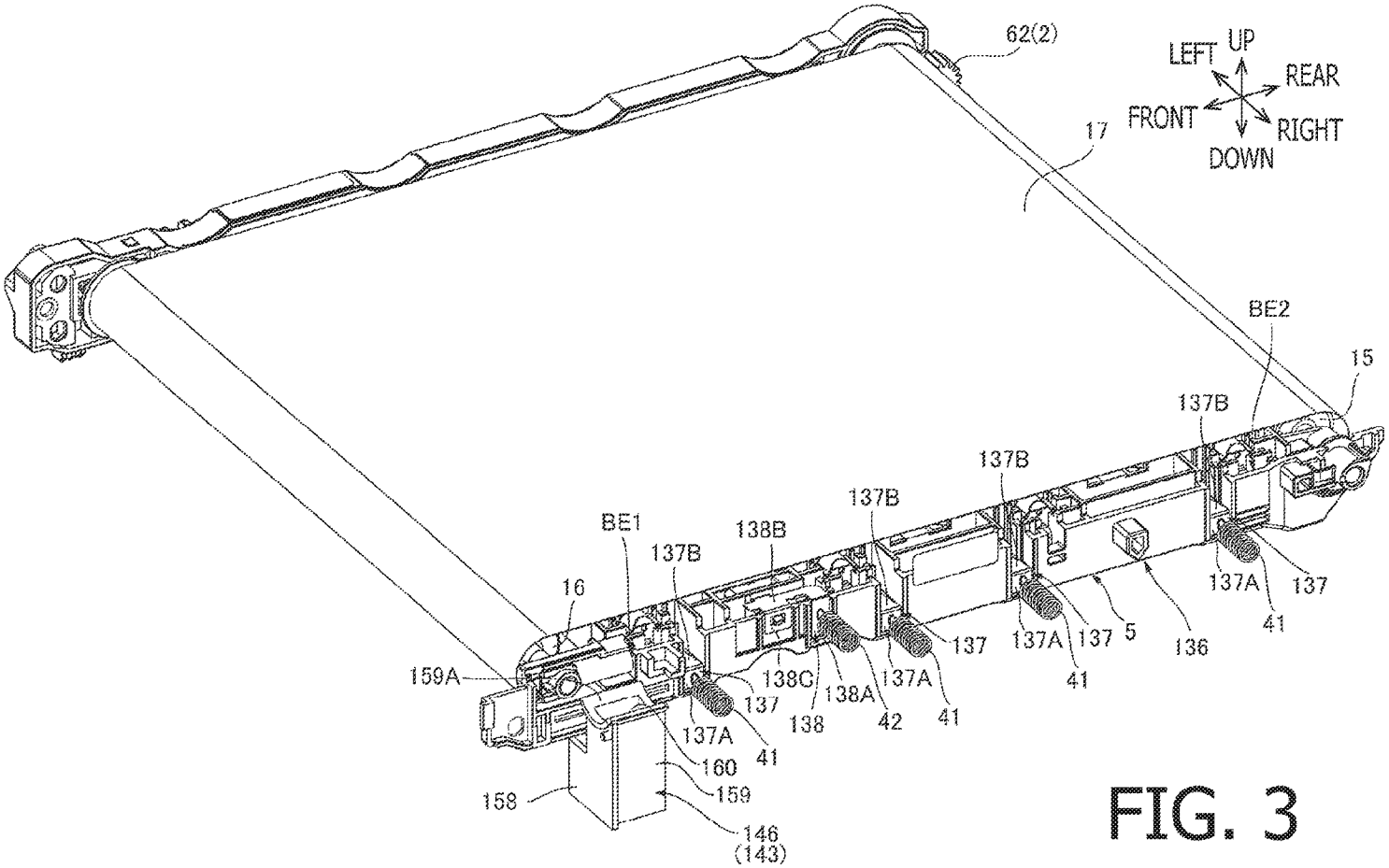
FIG. 3 is a perspective view of a belt unit shown in FIG. 1, viewed from an upper right side.
Figure 4:
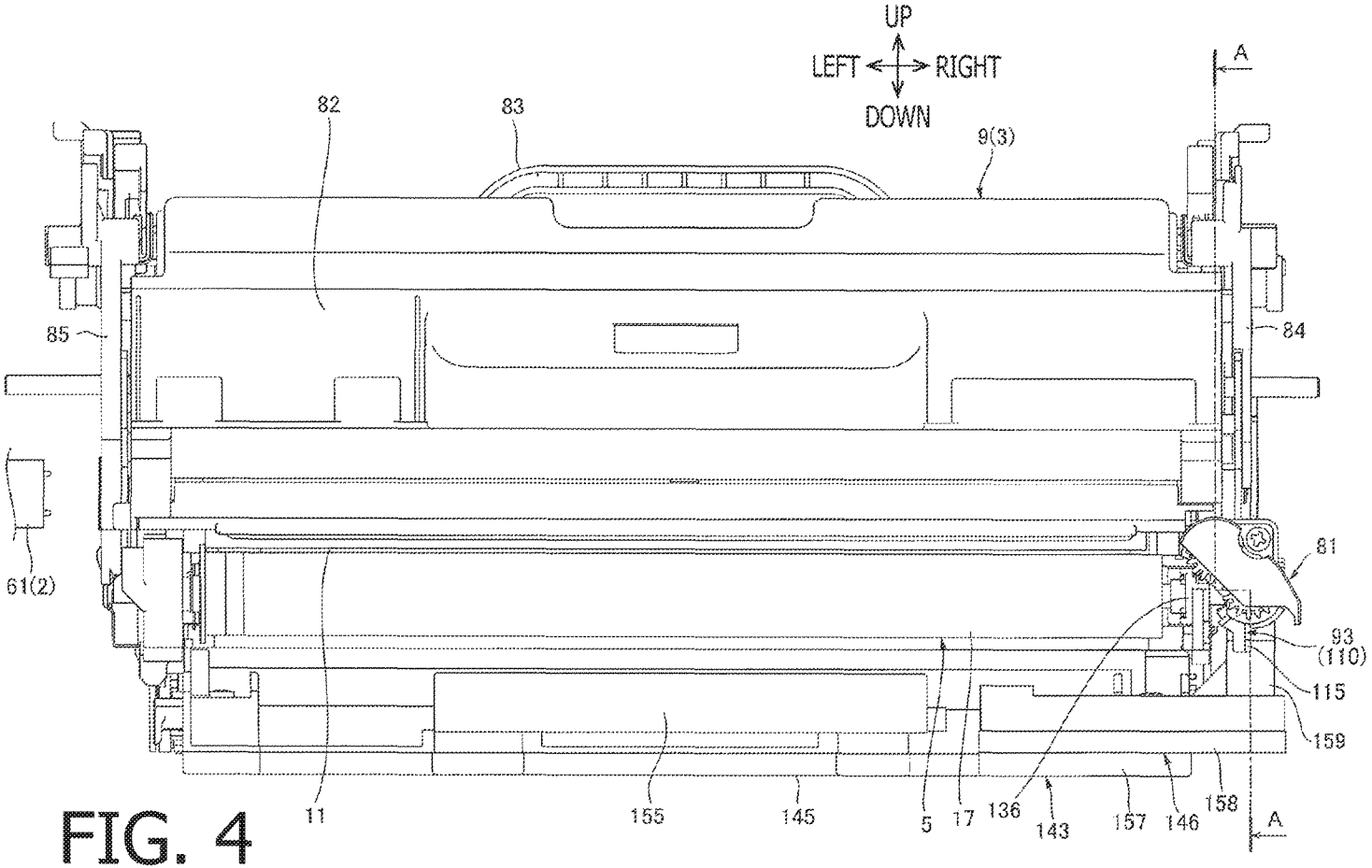
FIG. 4 is a front view of the drum unit, the belt unit and a waste toner storage unit.

The second side frame 57 forms a upper half part of the second frame 32. The second side frame 57 has a rectangular flat plate-like shape when viewed as a side view. As shown in FIGS. 3 and 4, the second side frame 57 includes a plurality of (four in this embodiment) body couplings 61, and a drive gear 62 of a driving input part for inputting a driving force.

As shown in FIG. 4, the four body couplings 61 are arranged in parallel with each other to be spaced from each other in the front and rear direction. The body coupling 61 is disposed on the left side of the corresponding photosensitive drum 11. The body coupling 61 is configured such that, in a state where the process unit 3 is attached to the body casing 2, the right end of the body coupling 61 is fitted to the left end part of the photosensitive drum 11. The body coupling 61 is configured to move along the left and right direction in conjunction with opening and closing motion of the front cover 22 by a known interlocking mechanism. Furthermore, the body coupling 61 is configured to rotate by receiving a driving force from a driving source such as a motor (not shown) provided in the body casing 2.

As shown in FIG. 3, the drive gear 62 is disposed at the lower rear part of the second side frame 57. The drive gear 62 has a cylindrical shape extending in the left and right direction, and includes gear teeth formed on the entire circumferential surface of the drive gear 62. The drive gear 62 is configured such that, in a state where the belt unit 5 is attached to the body casing 2, the upper front part of the drive gear 62 engages with a drive-receiving part (not shown) of the drive roller 15. Furthermore, the drive gear 62 is configured to rotate by receiving a driving force from a driving source such as a motor (not shown) provided in the body casing 2.

As shown in FIG. 6A, the second lower frame 58 extends downward to continue the lower end part of the second side frame 57. The second lower frame 58 has a rectangular flat plate-like shape when viewed as a side view. The right end of the second lower frame 58 projects to the right side with respect to the right end part of the second side frame 57. The second lower frame 58 includes a projection 64.

The projection 64 is disposed at the upper front part of the second lower frame 58. The projection 64 projects upward from the upper surface of the second lower frame 58. The projection 64 has a triangular shape in which the right surface of the projection 64 is leftwardly inclined toward the upper side. The right surface of the projection 64 is formed as a second inclined surface 64A.

Although not shown in the drawings, similarly to the first lower frame 35 of the first frame 31, the second lower frame 58 includes a support part 50 having a catching part 53, and an expanded part 51 having a positioning part 54. The support part 50 and the expanded part 51 of the second lower frame 58 and the support part 50 and the expanded part 51 of the first lower frame 35 are symmetrically disposed with respect to the center of the casing 2 in a front view.

3. Details about Drum Unit

Figure 2:
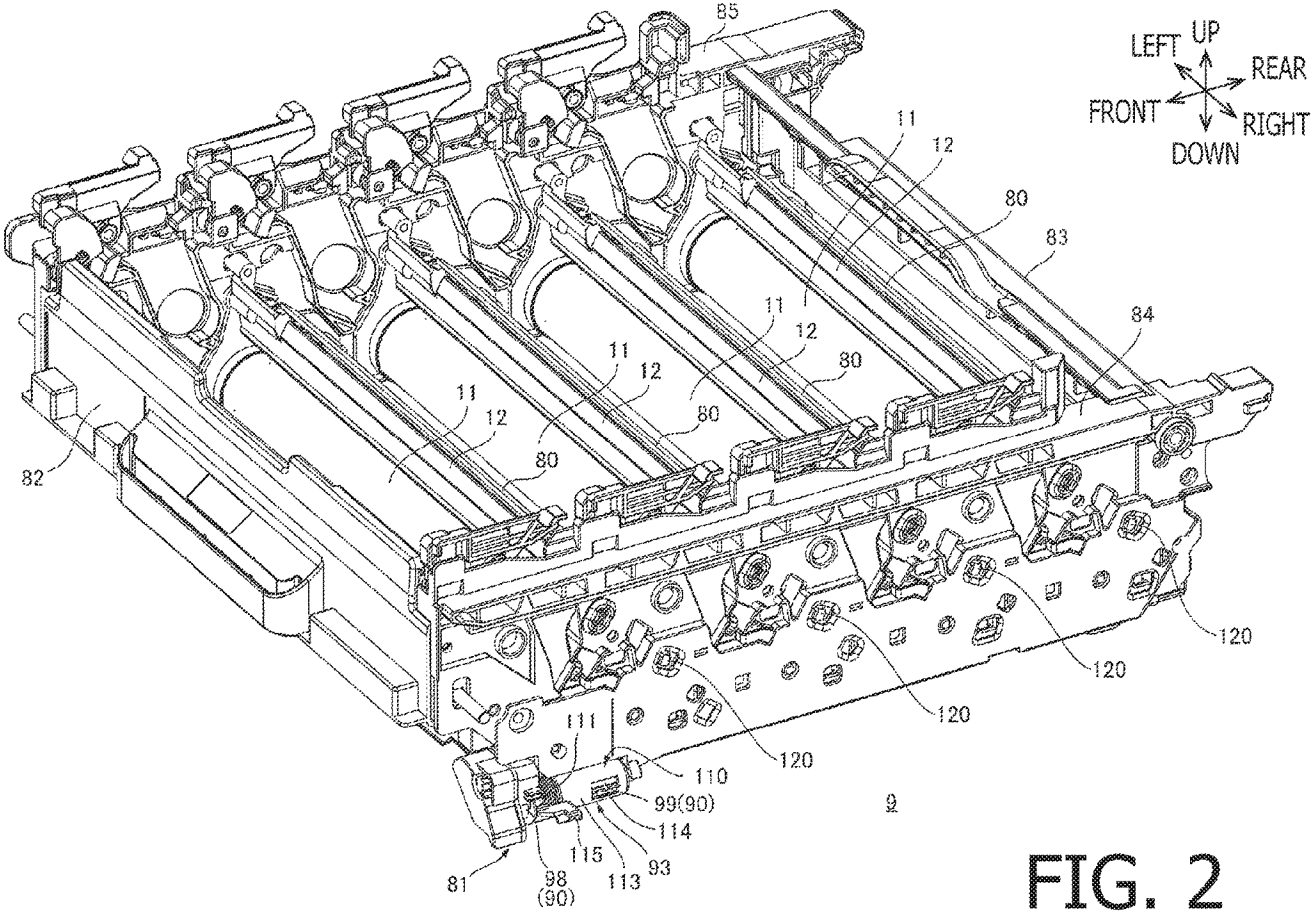
FIG. 2 is a perspective view of a drum unit shown in FIG. 1, viewed from an upper right side.

As shown in FIG. 2, the drum unit 9 has a rectangular frame shape when viewed as a plan view. The drum unit 9 includes cleaning units 80, a conveying unit 81, a front plate 82, a rear plate 83, a first side plate 84 and a second side plate 85.

(1) Cleaning Unit

As shown in FIGS. 1 and 2, the cleaning unit 80 is disposed on the rear side of the corresponding photosensitive drum 11. The cleaning unit 80 is configured to remove toner adhering and remaining on a surface of the photosensitive drum 11. As shown in FIG. 1, the cleaning unit 80 includes a frame 87, a blade 88 and a cleaning conveying unit 89.

The frame 87 has a shape of a half cylinder extending in the left and right direction, and is formed such that the left end part thereof is closed, and the right and front ends thereof are opened.

The blade 88 has a flat shape extending in the left and right direction. The upper end part of the blade 88 is fixed to the upper end part of the frame 87. The lower end part of the blade 88 faces the frame 87 from the front side so as to cover the upper half part of the opened part of the frame 87. Further, the lower end part of the blade 88 contacts the rear edge of the photosensitive drum 11 in a state of being bent rearward.

The cleaning conveying unit 89 is disposed in the frame 87. The cleaning conveying unit 89 is a right-hand auger screw extending in the left and right direction. The left end of the cleaning conveying unit 89 is rotatably supported by the left wall of the frame 87.

(2) Conveying Unit

Figure 5:
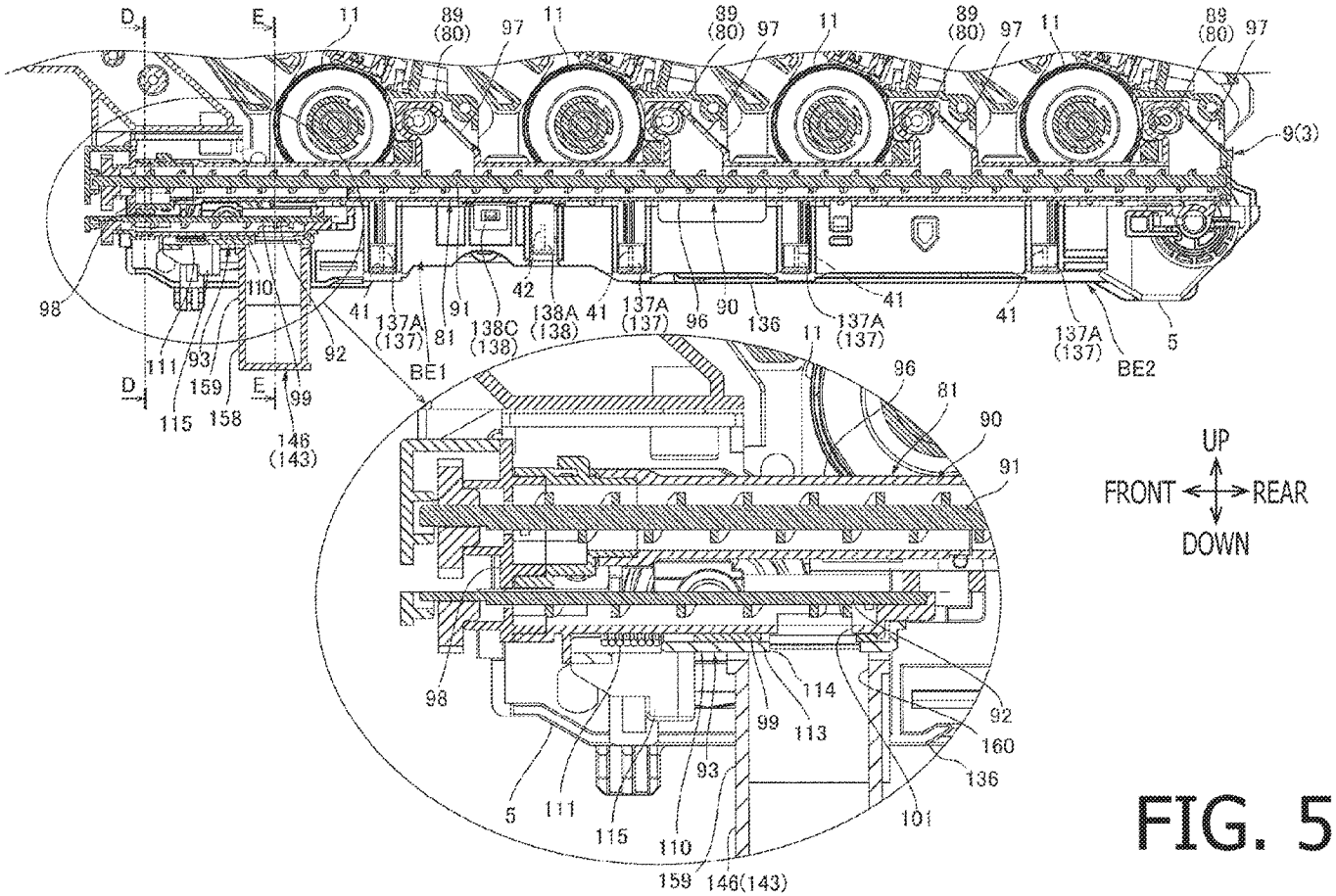
FIG. 5 is a cross sectional view along a line A-A in FIG. 4.

As shown in FIGS. 2 and 4, the conveying unit 81 is disposed at the lower right part of the drum unit 9. The conveying unit 81 is configured to convey toner removed from the surface of the photosensitive drum 11 by the cleaning unit 80, to a waste toner storage unit 143 which is described later. As shown in FIG. 5, the conveying unit 81 includes a conveying tube 90, a first conveying member 91, a second conveying member 92 and a shutter unit 93.

The conveying tube 90 is formed to extend in the front and rear direction, i.e., a moving direction of the drum unit 9. The conveying tube 90 includes a first conveying tube 96, a plurality of (four in this embodiment) connecting parts 97, a second conveying tube 98, and a third conveying tube 99 having a discharging outlet 101.

The first conveying tube 96 has a cylindrical shape extending in the front and rear direction, and is configured such that the rear end thereof is closed. The first conveying tube 96 is formed to extend in the front and rear direction over the entire region of the drum unit 9.

The four connecting parts 97 are disposed to be spaced with each other in the front and rear direction. The connecting part 97 has a cylindrical shape connecting the right end part of the frame 87 of the corresponding cleaning unit 80 and the upper end part of the first conveying tube 96. The connecting part 97 lets the inside and the outside of the first conveying tube 96 communicate with each other.

The second conveying tube 98 has a cylindrical shape extending to the lower right side from the front end part of the first conveying tube 96.

The third conveying tube 99 has a cylindrical shape extending to the rear side from the lower right end part of the second conveying tube 98, and is configured such that the rear end thereof is closed. The third conveying tube 99 is connected to the first conveying tube 96 by the second conveying tube 97 such that the outside and the inside of the third conveying tube 99 communicate with the first conveying tube 96. The rear end part of the third conveying tube 99 is disposed on the front side with respect to the center axis of the frontmost photosensitive drum 11 and the front side of the frontmost first body electric contact 41.

The discharging outlet 101 is disposed at the rear end part of the third conveying tube 99. The discharging outlet 101 penetrates through the lower peripheral wall of the third conveying tube 99 in the up and down direction. The discharging outlet 101 has a rectangular shape when viewed as a bottom view. The discharging outlet 101 is disposed on the front side of the center axis of the frontmost photosensitive drum 111, and on the front side of the frontmost first body electric contact 41.

The first conveying member 91 is disposed in the first conveying tube 96. The first conveying tube 91 is a right-hand auger screw extending in the front and rear direction. The rear end part of the first conveying member 91 is rotatably supported by a rear wall of the first conveying tube 96. The front end part of the first conveying member 91 extends to the front side with respect to the front end part of the first conveying tube 96, and is rotatably supported by a front wall of the second conveying tube 98.

As shown in FIG. 2, the shutter unit 93 is mounted on the third conveying tube 99 of the conveying tube 90. The shutter unit 93 includes a shutter 110 and a pressing member 111.

The shutter 110 is configured to be movable between a closing position shown in FIG. 2 where the shutter 110 closes the discharging outlet 101 of the third conveying tube 99 and a releasing position shown in FIG. 5 where the shutter 110 releases the discharging outlet 101 of the third conveying tube 99. In the following explanation about the shutter 110, the explanation is made with reference to a state where the shutter 110 is at the closing position shown in FIG. 2.

As shown in FIG. 2, the shutter 110 includes a shutter body 113 having a communication hole 114, and a projection 115.

The shutter body 113 has a cylindrical shape extending in the front and rear direction. The shutter body 113 receives therein the third conveying tube 99.

As shown in FIG. 2, the communication hole 134 penetrates through a right wall of the shutter body 113. The communication hole 114 has a rectangular shape when viewed as a side view. The communication hole 114 is disposed substantially at the same position as that of the discharging outlet 101 in regard to the front and rear direction.

The projection 115 is a flat plate-like member having a L-shape projecting to the right side from the front right end of the shutter body 113 when viewed as a side view. The front end of the projection 115 is disposed on the front side with respect to the front end of the shutter body 113. The projection 115 is disposed to extend rightward from the shutter body 113 when the shutter 110 is disposed at the closing position shown in FIG. 2. When the shutter 110 is disposed at the releasing position shown in FIG. 5, the projection 115 is disposed to extend downward from the shutter body 113 by contacting the contacting part 40 of the body casing 2.

As shown in FIG. 2, the pressing member 111 is a coil spring having a coil shape formed by winding a wire in a spiral shape along the front and rear direction. The pressing member 111 receives therein the front end part of the third conveying tube 99. The pressing member 111 overlaps with the projection 115 of the shutter 110 in regard to the front and rear direction. Although not shown in the drawings, the pressing member 111 is disposed such that one end of the wire of the pressing member 111 is fixed to the third conveying tube 99, and the other end of the wire of the pressing member 111 is fixed to the projection 115. With this configuration, the pressing member 111 constantly presses the projection 115 in the counterclockwise direction when viewed as a front view such that the pressing member 111 lets the shutter 110 be disposed at the closing position.

(3) Front Plate, Rear Plate, First Side Plate and Second Side Plate

The front plate 82 is disposed at the front end part of the drum unit 9. The front plate 82 has a rectangular flat plate-like shape elongated in the left and right direction when viewed as a front view.

The rear plate 83 is disposed at the rear end part of the drum unit 9. The rear plate 83 has a rectangular flat plate-like shape elongated in the left and right direction when viewed as a front view.

The first side plate 82 is disposed at the right end part of the drum unit 9. The first side plate 84 has a rectangular flat plate-like shape when viewed as a side view. The first side plate 84 includes a plurality of (four in this embodiment) drum electric contacts 120.

The four drum electric contacts 120 are disposed in a central part of the first side plate 84 in the up and down direction and are spaced from each other in the front and rear direction. The drum electric contact 120 is connected to the right end part of the corresponding scorotron charger 12. When the drum unit 9 is disposed at the inside position, the drum electric contact 120 contacts the corresponding third body electric contact 43 of the first frame 31, and supplies power from an external power source (not shown) to the scorotron charger 12 of the drum unit 9.

The second side plate 85 is disposed at the left end part of the drum unit 9 to be spaced leftward from the first side plate 84. The second side plate 85 has a rectangular flat plate-like shape when viewed as a side view.

4. Configuration of Belt Unit

As shown in FIGS. 1 and 3, the belt unit 5 includes a cleaning roller 135, a belt frame 136, a plurality of (four in this embodiment) first unit electric contacts 137, and one second unit electric contact 138. As shown in FIG. 1, the cleaning roller 135 is disposed between the frontmost transfer roller 18 and the second transfer roller 18 counted from the front side. The cleaning roller 135 has a shape of a circular column extending in the left and right direction. The lower edge of the cleaning roller 135 contacts the upper surface of the lower part of the belt 7.

As shown in FIG. 3, the belt frame 136 has a frame-like shape. The belt frame 136 supports the drive roller 15, the driven roller 16, the four transfer rollers 18, the cleaning roller 135 and the belt 17. As shown in FIG. 4, the belt frame 136 extends, in the left and right direction, to the outsides with respect to the left and right ends of the belt 17. As shown in FIG. 3, the front end part of the belt frame 136, i.e., one of ends of the belt frame 136 in the front and rear direction closer to the opening 21 is referred to as a first end part BE1, and the rear end part of the belt frame 136 is referred to as a second end part BE2.

As shown in FIG. 3, the four first unit electric contacts 137 are disposed to be spaced with respect to each other in the front and rear direction on the right surface of the belt unit 5. The frontmost first unit electric contact 137 is disposed at the first end part BE1, and the rearmost first unit electric contact 137 is disposed at the second end part BE2. As shown in FIGS. 3 and 6A, the first unit electric contact 137 is made of metal, and is formed of a flat plate-like member to form a shape of a letter L. That is, the first unit electric contact 137 is a metal plate. Specifically, the first unit electric contact 137 includes a contacting part 137A and a connecting part 137B.

The contacting part 137A has a rectangular flat plate-like shape when viewed as a side view.

The connecting part 137B has a rectangular flat plate-like shape extending to the left side when viewed as a plan view. The connecting part 137B is electrically connected to the transfer roller 18.

The first unit electric contact 137 is configured such that, by letting the contacting part 137A contact the first body electric contact 41, the connecting part 137B supplies power to the corresponding transfer roller 18.

As shown in FIG. 3, the second unit electric contact 138 is disposed between the frontmost first unit electric contact 137 and the first unit electric contact 137 disposed secondly from the frontmost first unit electric contact 137. The second unit electric contact 138 has a shape of a letter L formed of a plate-like member when viewed as a front view. Specifically, the second unit electric contact 138 includes a contacting part 138A, a first connecting part 138B and a second connecting part 138C.

The contacting part 138A has a rectangular flat plate-like shape when viewed as a side view.

The first connecting part 138B is formed to extend leftward from the upper end of the contacting part 138A such that the front end part of the first connecting part 138B is disposed on the front side with respect to the contacting part 138A. The first connecting part 138B has a rectangular flat plate-like shape when viewed as a plan view.

The second connecting part 138C is formed to extend downward from the front end part of the right end of the first connecting part 138B. The second connecting part 138C has a rectangular flat plate-like shape when viewed as a side view. The second connecting part 138C is electrically connected to the cleaning roller 135.

The second unit electric contact 138 is configured such that, by letting the contacting part 138A contact the second body electric contact 42, electric power is supplied from the second connecting part 138C to the cleaning roller 135 via the first connecting part 138B.

5. Configuration of Waste Toner Storage Unit

As shown in FIGS. 1 and 4, the image forming apparatus 1 further includes the waste toner storage unit 143.

In the body casing 2, the waste toner storage unit 143 is disposed on the opposite side of the drum unit 9 disposed at the inside position with respect to the belt unit 5. That is, the waste toner storage unit 143 is disposed under the belt unit 5. The waste toner storage unit 143 is configured to be detachably attachable to the body casing 2. The waste toner storage unit 143 includes a body part 145, a connecting part 146, a primary roller 147 and a secondary roller 148.

As shown in FIGS. 8A and 9A, the body part 145 has a box-like shape. The body part 145 is configured to store the toner removed by the cleaning unit 80. The body part 145 includes a first boss 151, a second boss 152, a third boss 153, a fourth boss 154 and a grip part 155.

As shown in FIG. 9A, the first boss 151 is disposed at the front right end part of the body part 145. The first boss 151 has a cylindrical shape projecting rightward from a right wall of the body part 145. The first boss 151 is fitted into the catching part 53 of the first frame 31 from the upper side.

As shown in FIG. 8A, the second boss 152 is disposed at the front left part of the body part 145. The second boss 152 has a common center axis with the first boss 151, and has a cylindrical shape projecting leftward from a left wall of the body part 145. Although not shown in the drawings, the second boss 152 is fitted into the catching part 53 of the second frame 32 from the upper side.

As shown in FIG. 9A, the third boss 153 is disposed at the rear right part of the body part 145 to be spaced rearward from the first boss 151. The third boss 153 has a cylindrical shape projecting rightward from the right wall of the body part 145. The third boss 153 is fitted into the positioning part 54 of the first frame 31 from the front side.

As shown in FIG. 8A, the fourth boss 154 is disposed at the rear left part of the body part 145 to be spaced rearward from the second boss 152. The fourth boss 154 has a common center axis with the third boss 153, and has a cylindrical shape projecting leftward from the left wall of the body part 145. Although not shown in the drawings, the fourth boss 154 is fitted into the positioning part 54 of the second frame 32 from the front side.

The grip part 155 is disposed at the front end part of the body part 145. The grip part 155 has a shape of a letter U of which the rear side is opened when viewed as a plan view. The grip part 155 is disposed such that one end and the other end of the grip part 155 are connected to the front end part of the body part 145.

The connecting part 146 is disposed at the front right end part of the waste toner storage unit 143. The connecting part 146 includes a first part 157, a second part 158, and a third part 159 having a communicating port 160.

The first part 157 has a box shape extending frontward from a front wall of the body part 145. The rear end part of the first part 157 communicates with the inner space of the body part 145.

The second part 158 has a shape of a rectangular cylinder extending rightward from the front right end part of the first part 157. The left end part of the second part 158 communicates with the inner space of the first part 157.

The third part 159 has a shape of a rectangular cylinder extending upward from the right end part of the second part 158. The lower end part of the third part 159 communicates with the second part 158. The upper end part of the third part 159 is formed as a peripheral surface 159A bending along the circumferential surface of the third conveying tube 99.

The communicating port 160 is a communicating part at the upper end part of the third part 159. That is, the communicating port 160 is formed at the peripheral surface 159A.

Thus, the connecting part 146 has a hollow shape communicating with the body part 145.

As shown in FIGS. 6B and 8A, the third part 159 and the right end part of the second part 158 of the connecting part 146 are accommodated in the recessed part 38 of the first side frame 34. At this time, as shown in FIGS. 6A and 6B, the left end part of the third part 159 of the connecting part 146 is disposed on the right side with respect to the left end part of the first body electric contact 41. Furthermore, the communicating port 160 overlaps with the first inclined surface 38A of the recessed part 38 in the up and down direction.

As shown in FIG. 5, when the drum unit 9 is disposed at the inside position, the connecting part 146 is disposed on the lower side of the discharging outlet 101, and communicates with the discharging outlet 101. That is, the discharging outlet 101 is disposed on the downstream side of the first unit electric contact 137 disposed on the most downstream side in regard to a direction in which the drum unit 9 proceeds from the inside position to the outside position.

As shown in FIG. 1, the primary roller 147 is disposed at the upper end of the body part 145 to be rotatable. The primary roller 147 has a cylindrical shape extending in the left and right direction. The primary roller 147 contacts the lower part of the belt 147 from the lower side. The primary roller 147 is configured to be supplied with electric power from an external power source (not shown) via an electric contact (not shown) of the first frame 31.

The secondary roller 148 is disposed in the body part 145 to be rotatable such that the secondary roller 148 contacts the lower rear edge of the primary roller 147. The secondary roller 148 has a cylindrical shape extending in the left and right direction. The secondary roller 148 is configured to be supplied with electric power from an external power source (not shown) via an electric contact (not shown) of the first frame 31.

As shown in FIGS. 8A and 9A, the front end part of the waste tone storage unit 143, i.e., an upstream end of the waste toner storage unit 143 in a direction in which the drum unit 9 proceeds from the outside position to the inside position is referred to as a first end part TE1. Further, the rear end part of the waste toner storage unit 143, i.e., a downstream end of the waste toner storage unit 143 in a direction in which the drum unit 9 proceeds from the outside position to the inside position is referred to as a second end part TE2.

6. Cleaning Operation

In image forming operation, the blade 88 of the cleaning unit 80 contacts the rotating photosensitive drum 11, and scrapes off and removes the toner remaining on the photosensitive drum 11 as shown in FIG. 1.

The toner removed from the surface of the photosensitive drum 11 falls to the inside of the frame 87.

At this time, the cleaning conveying member 89 is rotating in the counter clockwise direction when viewed as a right side view since a gear (not shown) receives a driving force from the photosensitive drum 11.

As a result, the toner in the frame 87 is conveyed to the right side by the cleaning conveying member 89.

Then, the toner conveyed to the right side in the frame 87 flows into the first conveying tube 96 via the connecting part 97 as shown in FIG. 5.

The first conveying member 91 is rotating in the clockwise direction when viewed as a front view by receiving a driving force from a driving source (not shown) in the body casing 2.

As a result, the toner which has flowed into the first conveying tube 96 is conveyed to the front side by the first conveying member 91.

Thus, the toner scraped off from the four photosensitive drums 11 is collected and is conveyed from the rear side to the front side in the first conveying tube 96.

The toner conveyed to the front end part of the first conveying tube 96 flows into the second conveying tube 98, moves to the lower right side in the second conveying tube 98 by its own weight, and flows into the front end part of the third conveying tube 99.

The second conveying member 92 is rotating in the counterclockwise direction when viewed as a front view by receiving a driving force transmitted from a driving source (not shown) in the body casing 2.

Then, the toner which has flowed into the front end part of the third conveying tube 99 is conveyed to the rear side by the second conveying member 92.

As a result, the toner is conveyed to the discharging outlet 101 in the third conveying tube 99, and is discharged to the connecting part 146 of the waste toner storage unit 143 via the discharging outlet 101.

The toner thus discharged is stored in the body part 145 via the connecting part 146.

As shown in FIG. 3, since electric power is supplied to the belt unit 5 via the second unit electric contact 138, a cleaning bias is applied to the cleaning roller 135 shown in FIG. 1.

Furthermore, as shown in FIG. 1, a primary cleaning bias is applied to the primary roller 147 of the waste toner storage unit 143, and a secondary cleaning bias is applied to the secondary roller 148.

As a result, the toner adhered to the belt 17 is caught by the secondary roller 148 after being caught by the primary roller 147, and is discharged to the body part 145.

Thus, the toner on the photosensitive drum 11 and the toner on the belt 17 are removed and are collected in the body part 145 of the waste toner storage unit 143.

7. Attaching/Detaching Operation for Drum Unit, Belt Unit and Waste Toner Storage Unit In order to detach the drum unit 9, the belt unit 5 and the waste toner storage unit 143 from the body casing 2, a worker first moves the drum unit 9 to the outside position. In order to dispose the drum unit 9 at the outside position, the worker releases the front cover 22 of the body casing 2 as shown in FIG. 1.

Then, as shown in FIG. 4, the body coupling 61 moves leftward in conjunction with the releasing operation of the front cover 22 by a known interlocking mechanism, and moves away from the corresponding photosensitive drum 11.

Then, the worker holds the drum unit 9, and withdraws the drum unit 9 via the opening 21.

At this time, the drum unit 9 slightly moves to the upper front side and then moves frontward by a guide (not shown) in the body casing 2.

Then, in accordance with movement of the drum unit 9, the drum electric contact 120 is detached from the corresponding third body electric contact 43.

Further, in accordance with the movement of the drum unit 9, the projection 115 of the shutter 110 is detached from the contacting part 40.

As a result, as shown in FIG. 2, the shutter 110 rotates in the counter clockwise direction when viewed as a front view by a pressing force from the pressing member 111, is disposed such that the projection 115 extends to the right side, and moves to the closing position where the discharging outlet 101 is closed by the peripheral wall of the shutter body 113.

Then, the worker withdraws the drum unit 9 to the front side.

Thus, the drum unit 9 is disposed at the outside position.

Next, the worker detaches the belt unit 5 from the body casing 2. In order to detach the belt unit 5, the worker holds the belt unit 5, and withdraws the belt unit 5 to the front side via the opening 21.

Then, as shown in FIG. 3, the belt unit 5 moves to the front side while passing through the left side of the third part 159 of the connecting part 146 of the waste toner storage unit 143.

Thus, the first unit electric contact 137 is detached from the corresponding first body electric contact 41, and the second unit electric contact 138 is detached from the second body electric contact 42.

As a result, the belt unit 5 is detached from the body casing 2.

Next, the worker detaches the waste toner storage unit 143 from the body casing 2 as shown in FIGS. 8A and 8B. In order to detach the waste toner storage unit 143, the worker holds the grip part 155, and lifts up the first end part TE1 of the waste toner storage unit 143 about the second end part TE2 of the waste toner storage unit 143 serving as a fulcrum. That is, the waste toner storage unit 143 rotates about the second end part TE2 serving as a fulcrum.

Then, as shown in FIGS. 7C and 9B, the first boss 151 is detached from the catching part 53 to the upper side. Although not shown in the drawings, the second boss 152 is detached to the upper side from a second catching part of the second frame 32.

Next, the worker further lifts up the first end part TE1 of the waste toner storage unit 143.

Then, as shown in FIG. 7B, when the first end part TE1 of the waste toner storage unit 143 is further lifted up to the upper side, the upper end part of the third part 159 is guided along the first inclined surface 38A, and the entire waste toner storage unit 143 moves leftward.

Then, as shown in FIG. 7C, when the first end part TE1 of the waste toner storage unit 143 is further lifted up to the upper side, the third part 159 is disposed on the left side with respect to the recessed part 38.

As a result, the body part 145 of the waste toner storage unit 143 is disposed on the left side with respect to the first body electric contact 41, the second body electric contact 42 and the third body electric contact 43.

Next, the worker holds the grip part 155, and withdraws the waste toner storage unit 143 to the front side.

Then, the waste toner storage unit 143 moves frontward such that the third boss 153 is detached from the positing part 54, and, although not shown in the drawings, the fourth boss 154 is detached from the second positioning part 54 of the second frame 32.

Thus, the detaching operation for the drum unit 9, the belt unit 5 and the waste toner storage unit 143 is completed.

In order to attach the drum unit 9, the belt unit 5 and the waste toner storage unit 143 to the body casing 2, reverse operation with respect to the above described detaching operation is performed.

Specifically, the worker holds the grip part 155 of the waste toner storage unit 143, and presses the waste toner storage unit 143 to the rear side.

At this time, as shown in FIG. 9B, the second end part TE2 of the waste toner storage unit 143 is positioned to be lower than the first end part TE1, and then the waste toner storage unit 143 is pushed rearward such that the waste toner storage unit 143 is guided by the expanded part 51 of the first lower frame 35 and the expanded part 51 of the second lower frame 58.

Then, the third boss 53 of the waste toner storage unit 143 is fitted to the positioning part 54 of the first lower frame 35, and the fourth boss 154 is fitted to the positioning part 54 of the second lower frame 58 although not shown in the drawings.

As a result, movement of the waste toner storage unit 143 to the rear side is restricted.

Next, the worker pushes the first end part TE1 of the waste toner storage unit 143 to the lower side about the second end part TE2 serving as a fulcrum.

As a result, the waste toner storage unit 143 moves to the lower side in the body casing 2 on the left side of the recessed part 38.

Then, the front left part of the body part 145 of the waste toner storage unit 143 contacts the second inclined surface 64A of the projection 64.

Thus, the body part 145 is guided to the right side along the inclined surface 64A, and, as shown in FIG. 6B, the entire waste toner storage unit 143 moves rightward and the connecting part 146 is accommodated in the recessed part 38.

Further, at this time, as shown in FIG. 9A, the first boss 151 is fitted to the catching part 53 of the first lower frame 53, and the second boss 152 is fitted to the catching part 53 of the second lower frame 58 although not shown in the drawings.

As a result, the waste toner storage unit 143 is attached to the body casing 2.

Next, the worker attaches the belt unit 5 to the body casing 2. In order to attach the belt unit 5 to the body casing 2, the worker holds the belt unit 5 and pushes the belt unit 5 to the rear side via the opening 21.

Then, as shown in FIG. 3, the belt unit 5 moves rearward such that the belt unit 5 passes through the left side of the third part 159 of the connecting part 143 of the waste toner storage unit 143.

Then, the first unit electric contact 137 contacts the corresponding first body electric contact 41, and the second unit electric contact 138 contacts the second body electric contact 42.

As a result, the belt unit 5 is attached to the body casing 2.

Next, the worker moves the drum unit 9 from the outside position to the inside position. On order to attach the drum unit 9 to the body casing 2, the worker holds the drum unit 9 and pushes the drum unit 9 to the rear side via the opening 21.

Then, the drum unit 9 moves rearward. Then, the projection 115 of the shutter 110 contacts the contacting part 40 of the body casing 2 while the drum unit 9 moves.

Next, when the worker further pushes the drum unit 9 to the rear side, the drum unit 9 is moves to the lower rear side while being guided by a guide (not shown), and is disposed at the inside position.

At this time, the projection 115 of the shutter 110 is disposed to extend downward by contacting the contacting part 40 of the body casing 2, and the shutter 110 is disposed at the releasing position.

As a result, the discharging outlet 101 of the third conveying tube 99 is connected to the communicating port 160 of the third part 159 of the connecting part 146 of the waste toner storage unit 143.

When the worker subsequently closes the front cover 22, the body coupling 61 moves right ward in accordance with the closing operation of the front cover 22 by a known interlocking mechanism, and is fitted to the corresponding photosensitive drum 11.

Thus, the drum unit 9 is attached to the body casing 2.

The attaching operation for the drum unit 9, the belt unit 5 and the waste toner storage unit 143 is thus completed.

8. Advantageous Effects (1) According to the configuration of the image forming apparatus 1, as shown in FIG. 5, the discharging outlet 101 through which the toner is discharged to the waste toner storage unit 143 is disposed on a downstream side with respect to the first body electric contact 41 in the direction of pointing from the inside position to the outside position of the drum unit 9 in a state where the drum unit 9 is disposed at the inside position.

Therefore, it is possible to prevent the discharging outlet 101 from being disposed on an upstream side with respect to the first body electric contact 41 in the direction of pointing from the inside position to the outside position of the drum unit 9 when the drum unit 9 is attached to or detached from the body casing 2.

That is, the drum unit 9 can be attached to or detached from the body casing 2 without causing the discharging outlet 101 to reach the first body electric contact 41. Therefore, it becomes possible to prevent the first body electric contact 41 from getting dirty by the toner.

(2) As shown in FIG. 5, according to the configuration of the image forming apparatus 1, it is possible to easily convey the toner to the waste toner storage unit 143 by a simple configuration in which the discharging outlet 101 of the third conveying tube 99 of the conveying tube 90 is connected to the communicating port 160 of the third part 159 of the connecting part 146.

(3) As shown in FIG. 6B, according to the configuration of the image forming apparatus 1, by accommodating the connecting part 146 in the recessed part 38 formed to be recessed rightward from the left surface of the first side frame 34 of the first frame 31, space of the body casing 2 can be saved.

(4) As shown in FIGS. 6A and 6B, according to the configuration of the image forming apparatus 1, since the connecting part 146 is disposed on the right side with respect to the left end part of the first body electric contact 41, it becomes possible to let the first unit electric contact 137 contact the first body electric contact 41 from the left side without causing the belt unit 5 to contact the connecting part 146 of the waste toner storage unit 143.

(5) As shown in FIGS. 5 and 6B, according to the configuration of the image forming apparatus 1, since the connecting part 146 is formed to extend upward from the body part 145, the toner can be conveyed to the body part 145 by its own weight.

Therefore, there is no necessity to provide a component to convey the toner which has discharged to the connecting part 146, to the body part 15. Consequently, the number of components can be reduced.

(6) As shown in FIGS. 5 and 6A, according to the configuration of the image forming apparatus 1, it becomes possible to supply electric power to the transfer roller 18 by letting the first body electric contact 41 contact the first unit electric contact 137.

(7) As shown in FIG. 5, according to the configuration of the image forming apparatus 1, the first unit electric contact 137 contacting the first body electric contact 41 is disposed at the first end part BE1, and the discharging outlet 101 is disposed on the downstream side with respect to the first body electric contact 41 in the direction in which the drum unit 9 proceeds from the inside position to the outside position.

Therefore, it becomes possible to prevent the first unit electric contact 137 from getting dirty by toner while making it possible to supply electric power to the belt unit 5.

(8) As shown in FIG. 3, according to the configuration of the image forming apparatus 1, by detaching the belt unit 5 from the body casing 2, it becomes possible to perform maintenance for the belt unit 5 and to perform maintenance for the waste toner storage unit 143.

(9) As shown in FIG. 6A, according to the configuration of the image forming apparatus 1, since the first body electric contact 41 is made of metal, electric power can be securely supplied. Furthermore, since the first body electric contact 41 is a coil spring, the first body electric contact 41 can be caused to securely contact the first unit electric contact 137 by a pressing force of the first body electric contact 41.

(10) As shown in FIGS. 5 and 6A, according to the configuration of the image forming apparatus 1, since the first unit electric contact 137 is formed of a metal plate, a contact surface with respect to the first body electric contact 41 can be secured.

As a result, it becomes possible to securely supply electric power from the first body electric contact 41 to the first unit electric contact 137.

(11) As shown in FIGS. 6B and 8A, according to the configuration of the image forming apparatus 1, the communicating port 160 of the waste toner storage unit 143 is disposed to overlap with the first inclined surface 38A in the up and down direction. Therefore, by lifting up the waste toner storage unit 143 when the waste toner storage unit 143 is detached from the body casing 2, the upper end part of the third part 159 at which the communicating port 160 is formed contacts the first inclined surface 38A.

As a result, as shown in FIGS. 7A and 8B, it is possible to move the waste toner storage unit 143 to the left side along the first inclined surface 38A of the waste toner storage unit 143.

Therefore, as shown in FIGS. 7A and 8B, it is possible to move the waste toner storage unit 143 to the left side along the first inclined surface 38A.

As a result, a space can be secured in the left and right direction between the waste toner storage unit 143 and the body casing 2, and thereby it becomes possible to prevent the waste toner storage unit 143 from contacting components in the body casing 2 when the waste toner storage unit 143 is detached from the body casing 2.

As a result, it becomes possible to smoothly detach the waste toner storage unit 143 from the body casing 2.

(12) As shown in FIGS. 6B and 7C, according to the configuration of the image forming apparatus 1, by moving the waste toner storage unit 143 downward when the waste toner storage unit 143 is attached to the body casing 2, the waste toner storage unit 143 is caused to move rightward along the second inclined surface MA, and thereby the waste toner storage unit 143 can be moved easily to the recessed part 38.

As a result, it becomes possible to dispose the communicating port 160 to overlap with the first inclined surface 38A in the up and down direction in a state where the drum unit 9 is disposed at the inside position.

(13) Furthermore, as shown in FIGS. 3, 4 and 8A, according to the configuration of the image forming apparatus 1, the waste toner storage unit 143 can be attached to or detached from the body casing 2 such that the waste toner storage unit 143 does not contact electric contacts, such as the first body electric contact 41, the second body electric contact 42 and the third body electric contact 43, and driving input parts, such as the body coupling 61 and the drive gear 62.

Therefore, it becomes possible to securely supply electric power to the transfer roller 18 and the cleaning roller 135 of the belt unit 5 via the first body electric contact 41 and the second body electric contact 42, and to securely supply electric power to the scorotron charger 12 of the drum unit 9 via the third body electric contact 43.

(14) As shown in FIG. 1, according to the configuration of the image forming apparatus 1, it is possible to securely scrape off and remove the toner on the photosensitive drum 11 by the blade 88 of the cleaning unit 80.

(15) As shown in FIG. 5, according to the configuration of the image forming apparatus 1, the first conveying member 91 and the second conveying ember 92 are auger screws. Therefore, it is possible to securely convey the toner in the conveying tube 90.

(16) As shown in FIGS. 6B and 8A, according to the configuration of the image forming apparatus 1, the connecting part 146 having the communicating port 160 is formed to extend to the upper side with respect to the body part 145. Therefore, as shown in FIGS. 7A and 7B, it is possible to firstly let the third part 159 of the connecting part 146 contact the first inclined surface 38A as shown in FIGS. 7A and 7B, and then to detach the waste toner storage unit 143 from the body casing 2 after the body part 145 is securely moved leftward.

As a result, it becomes possible to securely prevent the body part 145 from contacting components disposed in the body casing 2.

(17) As shown in FIGS. 5 and 8A, according to the configuration of the image forming apparatus 1, the connecting part 146 is formed to extend upward from the body part 145 and is formed to have a hollow shape. Therefore, it becomes possible to let the toner fall by its own weight via the connecting part 146 and be stored in the body part 145.

(18) As shown in FIGS. 2 and 3, according to the configuration of the image forming apparatus 1, the third part 159 of the connecting part 146 includes the peripheral surface 159A formed along the circumferential surface of the conveying tube 90. Therefore, as shown in FIG. 5, it becomes possible to discharge the toner to the communicating port 160 via the discharging outlet 101 of the conveying tube 90 without causing the toner to leak.

(19) As shown in FIGS. 6B and 7A, according to the configuration of the image forming apparatus 1, the waste toner storage unit 143 can be moved rightward when the waste toner storage unit 143 is attached to the body casing 2.

Therefore, it becomes possible to dispose the connecting part 146 of the waste toner storage unit 143 to be securely disposed in the recessed part 38.

Furthermore, when the waste toner storage unit 143 is detached from the body casing 2, the waste toner storage unit 143 can be moved leftward by letting the upper end part of the third part 159 of the connecting part 146 contact the first inclined surface 38A as shown in FIGS. 7A and 7B.

As a result, a space can be secured in the left and right direction between the waste toner storage unit 143 and the body casing 2, and thereby it becomes possible to prevent the waste toner storage unit 143 from contacting components in the body casing 2.

Consequently, it becomes possible to smoothly attached the waste toner storage unit 143 to or detach the waste toner storage unit 143 from the body casing 2.

(20) As shown in FIGS. 9A and 9B, according to the configuration of the image forming apparatus 1, the first end part TE1 can be easily positioned with respect to the body casing 2 by letting the third boss 153 be fitted to the positioning part 54 of the first frame 31 and letting the fourth boss 154 be fitted to the positioning part 54 of the second frame 32 in the second end part TE2, and subsequently rotating the waste toner storage unit 143 about the second end part TE2 serving as fulcrum after positioning the waste toner storage unit 143 with respect to the body casing 2.

Therefore, it is possible to smoothly attach the waste toner storage unit 143 to the body casing 2.

Second Embodiment

Hereafter, a second embodiment is described with reference to FIG. 10. In the second embodiment, to elements which are similar to those of the first embodiment, similar reference numbers are assigned, and explanations thereof will not be repeated.

In the above described first embodiment, the belt unit 5 and the waste toner storage unit 143 are separately attached to or detached from the body casing 2 as shown in FIGS. 3 and 8B.

By contrast, according to the second embodiment, the belt unit 5 and the waste toner storage unit 143 are configured as an integrated component as shown in FIG. 10.

As a result, the belt unit 5 and the waste toner storage unit 143 are collectively attached to or detached from the body casing 2.

According to the image forming apparatus of the second embodiment, since the belt unit 5 and the waste toner storage unit 143 are formed as an integrated component, it is possible to cause the belt unit 5 and the waste toner storage unit 143 to be collectively attached to or detached from the body casing 2.

According to the second embodiment, the advantageous effects achieved by the first embodiment can also be achieved.

What is claimed is:

1. An image forming apparatus, comprising:

a body casing having a body electric contact configured to be electrically connected to a power source;

a drum unit configured to move between an inside position inside the body casing and an outside position outside the body casing in a moving direction of the drum unit, the drum unit comprising:

a photosensitive drum having an axis extending in an axis direction;

a cleaning unit configured to remove toner remaining on a surface of the photosensitive drum; and a conveying unit configured to convey the toner removed by the cleaning unit;

a belt unit having a belt frame, the belt unit comprising:

a belt in contact with the photosensitive drum of the drum unit when the drum unit is disposed at the inside position, the belt being supported by the belt frame; and a unit electric contact disposed on an outer surface of the belt frame in the axis direction and contacts the body electric contact; and a waste toner storage unit configured to store the toner conveyed by the conveying unit, the conveying unit comprising:

a conveying member configured to convey the toner removed by the cleaning unit in the moving direction; and a conveying tube extending in the moving direction and accommodating the conveying member, the conveying tube having a discharging outlet configured to let the toner carried by the conveying member be discharged to the waste toner storage unit through the discharging outlet, the discharging outlet of the conveying tube being disposed on a downstream side with respect to the body electric contact in a direction pointing from the inside position to the outside position of the drum unit in a state where the drum unit is disposed at the inside position, wherein the waste toner storage unit comprises a connecting part having a communicating port configured to communicate with the discharging outlet in the state where the drum unit is disposed at the inside position, wherein:

the body casing comprises a body frame having a recessed part configured to accommodate the connecting part, and the recessed part of the body casing is formed to be recessed toward an outside in the axis direction from an inner surface of the body frame in the axis direction.

2. The image forming apparatus according to claim 1, wherein the connecting part of the waste toner storage unit is disposed on an outer side in the axis direction with respect to an inner end of the body electric contact in the axis direction.

3. The image forming apparatus according to claim 1, wherein:

the waste toner storage unit comprises a body part configured to store the toner; and the connecting part is formed to extend upward from the body part and comprises the communicating port on an upper surface of the connecting part.

4. The image forming apparatus according to claim 1, wherein the belt unit comprises a transfer roller disposed; under the photosensitive drum and on an opposite side of the photosensitive drum with respect to the belt, the transfer roller being electrically connected to the unit electric contact.

5. The image forming apparatus according to claim 1, wherein:

the belt frame comprises a first end part disposed on an upstream side in a direction pointing from the outside position to the inside position of the drum unit, and a second end part disposed on a downstream side in the direction pointing from the outside position to the inside position of the drum unit, and the unit electric contact is disposed at the first end part.

6. The image forming apparatus according to claim 1, wherein the belt unit is configured to be detachably attachable to the body casing.

7. The image forming apparatus according to claim 1, wherein the belt unit and the waste toner storage unit are formed as an integrated component.

8. The image forming apparatus according to claim 1, wherein the body electric contact is formed of a coil spring made of metal.

9. The image forming apparatus according to claim 8, wherein the unit electric contact is formed of a metal plate.

* * * * *